United States Patent [19]

Rustum

[11] 4,430,256

[45] Feb. 7, 1984

[54] REVERSE THERMODYNAMIC CHEMICAL BARRIER FOR NUCLEAR WASTE OVER-PACK OR BACKFILL

[76] Inventor: Roy Rustum, 528 S. Pugh, State College, Pa. 16801

[21] Appl. No.: 280,193

[22] Filed: Jul. 6, 1981

[51] Int. Cl.[3] ..... G21F 9/16

[52] U.S. Cl. ..... 252/628; 252/633; 405/128; 405/129

[58] Field of Search ..... 252/628, 633; 405/128, 405/129

[56] References Cited

U.S. PATENT DOCUMENTS 4,189,254 2/1980 Akesson ..... 405/128

4,333,847 6/1982 Tran et al. ..... 264/0.5

OTHER PUBLICATIONS

McCarthy *Scientific Basis for Nuclear Waste Management* (Barney, "Variables Affecting Sorption & Transport of Radionuclides in Hamford Subsoils)" pp. 435–438, 1978 Plenum Press (vol. I).

*Primary Examiner*—Brooks H. Hunt

*Attorney, Agent, or Firm*—Cushman, Darby & Cushman

[57] ABSTRACT

Radioactive waste is stored surrounded by an overpack or backfill containing non-radioactive ions of the same radioactive elements as in the waste form. In place of an overpack of the actinides, there can be used an overpack of the chemically similar lanthanides. Thus, there can be used in the overpack cesium and strontium containing aluminosilicates and cesium, strontium and lanthanide aluminates and silicates.

22 Claims, 6 Drawing Figures

REVERSE THERMODYNAMIC CHEMICAL BARRIER FOR NUCLEAR WASTE OVER-PACK OR BACKFILL

BACKGROUND OF THE INVENTION

The disposal of large quantities of toxic materials such as high level radioactive wastes stored in spent reactor storage pools, or generated in the reprocessing of spent nuclear reactor fuel, or generated in the operation and maintenance of nuclear power plants, is a problem of considerable importance to the utilization of nuclear power. It is generally accepted that the most promising approach is to convert these radioactive wastes to a dry solid form which would render such wastes chemically and thermally stable.

The problem of dry solid stability of radioactive wastes is related to the safety of human life on earth. For example, radioactive wastes usually contain the isotopes $Sr^{90}$, $Pu^{239}$, and $Cs^{137}$ whose half lives are 28 years, 24,000 years, and 30 years, respectively. These isotopes alone pose a significant threat to life and must be put into a dry, solid form which is stable for thousands of years. Any solid radioactive waste package must be able to keep the radioactive isotopes immobilized for this length of time, preferably even in the presence of an aqueous environment. The radioactive wastes are produced in high volumes and contain long-lived, intermediate-lived, and short-lived radioactive ions and some non-radioactive ions.

The two most popular types of commercial reactors, both of which produce low level wastes, are the Boiling Water Reactor (B.W.R.) and the Pressurized Water Reactor (P.W.R.). In a typical Pressurized Water Reactor (P.W.R.), pressurized light water circulates through the reactor core (heat source) to an external heat sink (steam generator). In the steam generator, where primary and secondary fluids are separated by impervious surfaces to prevent contamination, heat is transferred from the pressurized primary coolant to secondary coolant water to form steam for driving turbines to generate electricity. In a typical Boiling Water Reactor (B.W.R.), light water circulates through the reactor core (heat source) where it boils to form steam that passes to an external heat sink (turbine and condenser). In both reactor types, the primary coolant from the heat sink is purified and recycled to the heat source.

The primary coolant and dissolved impurities are activated by neutron interactions. Materials enter the primary coolant through corrosion of the fuel elements, reactor vessel, piping, and equipment. Activation of these corrosion products adds radioactive nuclides to the primary coolant. Corrosion inhibitors, such as lithium, are added to the reactor water. These chemicals are activated and add radionuclides to the primary coolant. Fission products diffuse or leak from fuel elements and add nuclides to the primary coolant. Radioactive materials from all these sources are transported around the system and appear in other parts of the plant through leaks and vents as well as in the effluent streams from processes used to treat the primary coolant. The mitigation of these normal engineering process leaks gives rise to a substantial volume of low and intermediate level wastes.

On the other hand, the dissolution in nitric acid of the spent nuclear reactor fuel generates the so-called "high level radioactive nuclear waste liquids" which must eventually be solidified. Both of these types of radioactive wastes—high and low level—present problems in regard to transportation, disposal, storage, and immobilization of the same.

The present invention is directed to a novel article, i.e., a secondary "container" or retarder for containerizing and storing radioactive solids primarily containing cesium, strontium, and actinide ions as well as novel processes for making such "containers" and storing such radioactive solids.

SUMMARY OF THE INVENTION

Up to the present time, all buffer materials have been designed to be "inert," or absorptive of the dangerous radionuclides chiefly Cs, Sr, and Actinides, but including all the normal fission product ions, I, Tc, etc. The buffer materials proposed have been rather generally quartz, clays (typically bentonite) and zeolites (and including $FeSO_4$ as an Eh buffer).

The present invention starts with a very different concept. The concept is the use, for example, of non-radioactive Cs, Sr, I, Mn, and Ln (lanthanide) in higher concentration than the same or analogous elements in the waste as a positive-action buffer. By this is meant that any reactions of the waste with the buffer will take place in a gradient of concentration that will be inward towards the waste form with respect to the most threatening nuclides. To achieve this, the present invention provides an overpack containing material with a higher chemical activity of Sr, Cs, and Ln or the like in the solid or in any solution in equilibrium with both waste and overpack.

Typical materials which may be employed for such overpacks include, for example, the Cs and Sr containing aluminosilicates (including clays, zeolites, feldspars) and Cs, Sr, Ln aluminates and silicates, as well as carbonates, sulfates, and titanates where appropriate. The phases desirably are near to thermodynamic equilibrium with each other and with the radiophase(s) of the waste form. The ideal is to have the activity of each of the cold nuclides just slightly (say one order of magnitude) higher in contact with the overpack than the waste.

Examples of Positive Chemical Buffers for nuclear waste canisters include:

(a) Mixtures of $CsAlSiO_4$, Sr-feldspar, Ln silicate.

(b) Mixture of fixed (i.e., heated) Cs-vermiculite; Sr-wairakite + Ln-stabilized Y-zeolite + Pb-I zeolite.

(c) Mixture of fixed Cs-chabazite; $SrCO_3$; $CePO_4$; pyrolusite.

DETAILED DESCRIPTION

Figure 1:
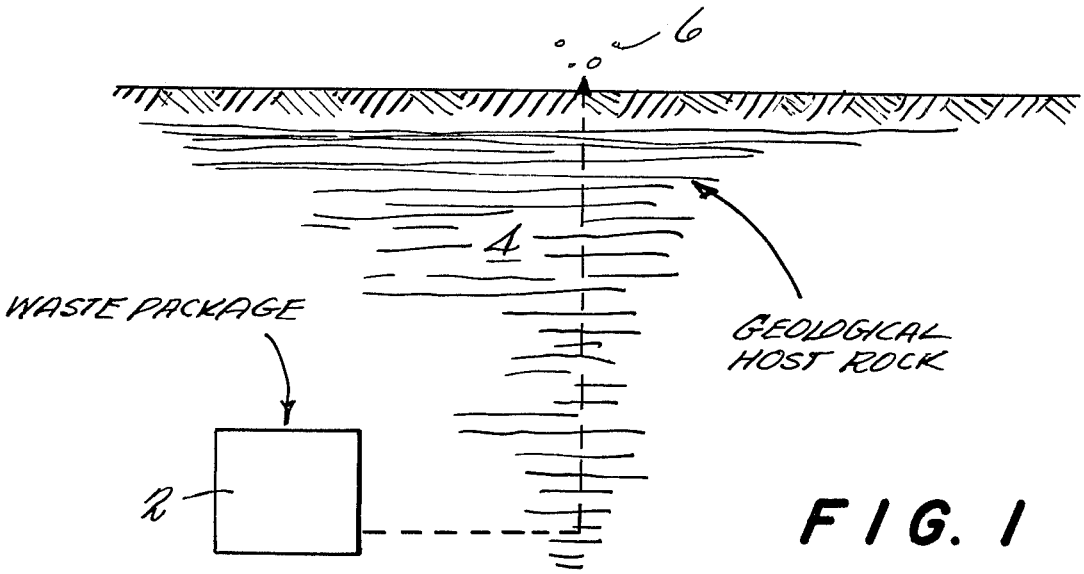
FIG. 1 is a schematic representation of the basic system.

The safe disposal of nuclear waste has exercised the concern of the entire scientific community. As shown in FIG. 1 at present the system relies on two separate major components in the system to prevent radionuclides from reaching the biosphere 6, from the waste package 2, through the geological host rock 4.

FIG. 1 shows the waste package 2 in repository designed to be maximally insoluble, so as not to release radionuclides under repository conditions and the geological host rock 4 selected to make travel of radionuclides to the surface maximally slow and difficult.

Figure 2:
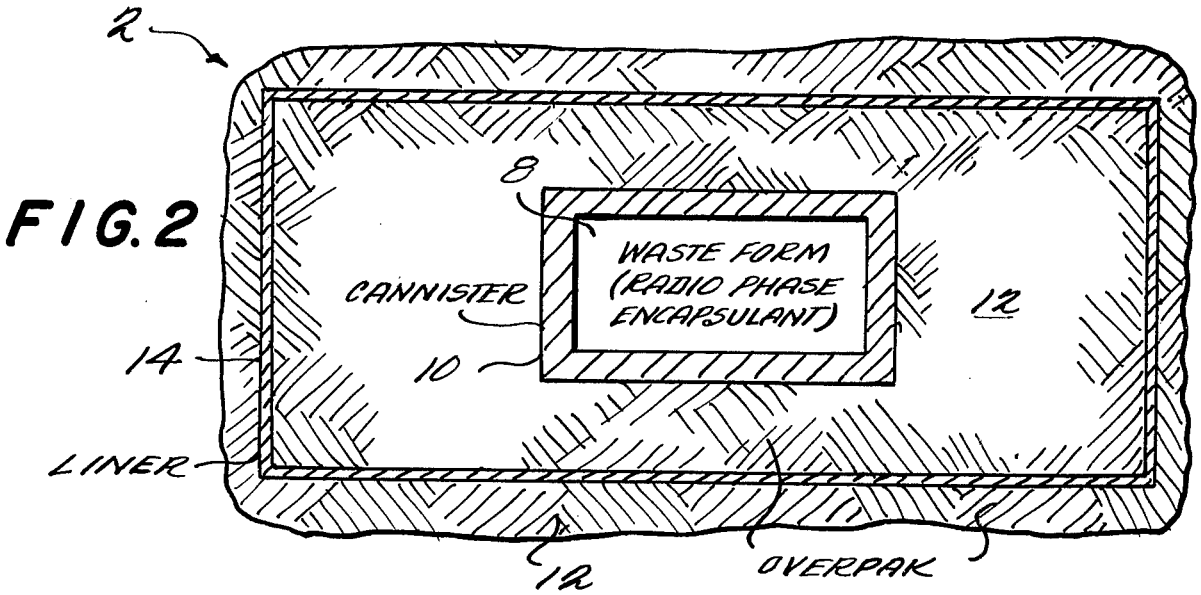
FIG. 2 is a schematic representation of the waste package.

The present invention is concerned with barrier 2. If barrier 2 is looked at in greater detail, this can be conceived as a series of sequential component barriers (by analogy to the series of nested Russian dolls) each barrier offering resistance to the release of ions from the total package. This waste package 2 then consists of four components, as shown in FIG. 2, namely the waste form (radio phase+encapsulant) 8, the canister 10, overpack 12, and liner 14.

Previously, virtually all of the research and invention on the waste package has focused on 8 the waste form, with some attention on 10 the canisters. The design objective has been to make these materials maximally insoluble in the repository environment.

Figure 3:
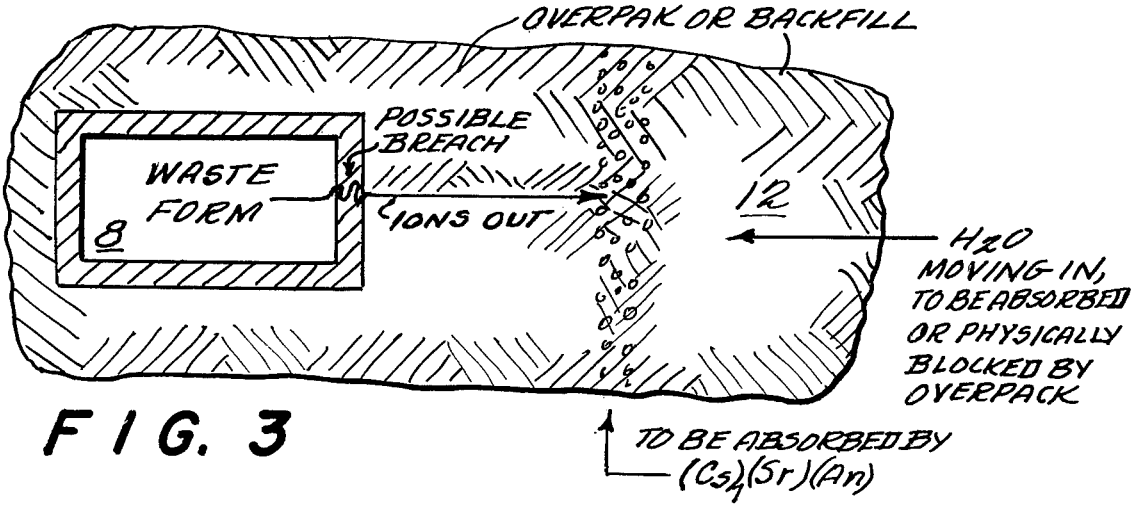
FIG. 3 is a schematic representation of the process of ion transfer.

The invention is directed to the barrier 12, the overpack (also sometimes called the backfill). Previous concern with this component has been shown in the Swedish KBS plan, where a mixture of bentonite, quartz, and ferrous phosphate was proposed. The present inventor and his colleagues in the past also have presented various papers in which they have designed new materials for this barrier. The goal of all the art to date, regarding the function of this overpack barrier 12 is shown in connection with FIG. 3.

Up to the present, this barrier has been conceived as a means either excluding water or of absorbing (and reacting with, in some degree) the dangerous radionuclides, chiefly Cs, Sr, and the actinides (generic symbol, An). Illustrative of the actinides with which the present invention is concerned are Th, U, Pu, Am, Np and Pa. Other important radionuclides include I and Tc.

Figure 4:
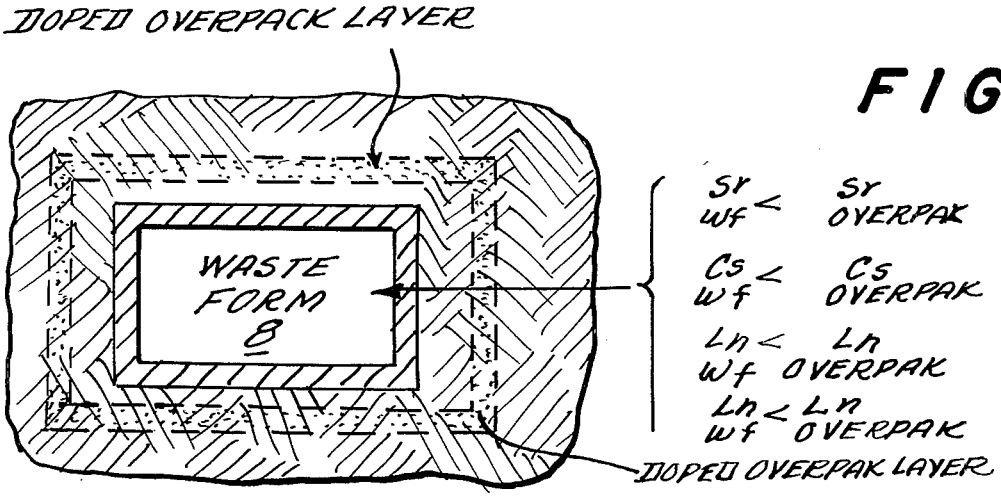
FIG. 4 is a schematic representation of key elements of the systems.

The fundamental innovation in the present invention is to reverse the chemical concentrations so that there will be a tendency for Cs, Sr, I, Tc, and An ions or in place of An ions optionally Ln (lanthanide) ions to move into the waste form rather than the other way. This is achieved by changing the gradient of the chemical potential of the elements of concern, so that there will be a minimum chemical driving force for any of the dangerous species to migrate outward. This reverse chemical potential gradient is very easily attained. It simply requires that the overpack be saturated with minerals or chemicals containing Sr, Cs, Ln, etc., which are more soluble than the waste form in the repository fluids. This is shown in FIG. 4. The only meaningful threat comes from transport and reaction in fluids since solid state diffusion rates are much too slow to be of concern. The elements of concern only enter these solutions as ions. Diffusion processes in the liquid will move ions from high concentration areas to low concentration areas. Thus, one creates a positive chemical potential gradient for these ionic species towards the waste form, if and when there is a breach of the containment and material can flow (ever so slowly) in or out of the canister.

In lieu of the aforesaid "overpack" container technique is the backfill technique. That is to say, the earth surrounding a "normal" canister (a container not characterized by an overpack material) comprises non-radioactive ions of higher activity than the same radioactive ions stored in the "normal" canister. By this backfill technique, pernicious radioactive ions eventually escape from the container but are "prevented from diffusing further" by the same non-radioactive ions comprising the backfill.

In other words, the overpack or backfill in this invention is designed not only to absorb the radionuclides of the dangerous elements Cs, Sr, An, I, Tc originating in the waste form, but it is also designed to block the out migration of any such ions by providing a supply of non-radioactive atoms of the same elements outside the canister, mixed into the overpack. This layer of non-radioactive (hence not dangerous) atoms of the same elements serves as a highly impenetrable chemical or thermodynamic barrier. Most of the long-term threat is from the $\alpha$-emitting actinides. It is easy enough to obtain non-radioactive Cs and Sr chemicals and minerals. However, except for uranium and thorium, the actinides are all laboratory rarities. Hence there is used instead as excellent imitators or substitutes the larger, lighter members of the lanthanide group. Because of the identity of the ionic radii the corresponding ions from the two series are very similar in solid state reactions.

Thus, there can be used principally, La, Ce, Pr, Nd, Sm, Eu, Gd, or mixtures thereof with yttria earth in place of the actinides. In place of Tc, there can be used the much more common Mn.

This invention relates to any radionuclide, and the blocking of its migration by incorporating a stable nuclide of the same element in the overpack or a replacement element such as a lanthanide or Mn.

A major advantage of the present invention over the conventional efforts to make increasingly insoluble waste forms, is the fantastic complexity and expense of working with highly radioactive materials in a remote "canyon" facility. The engineering of the overpack or backfill is a matter of extreme simplicity since none of the matter is radioactive, it consists of selecting the desirable mineral (or ceramic) phase and mixing it into the overpack as loose powder to be tamped, or as formed shapes.

Figure 5:
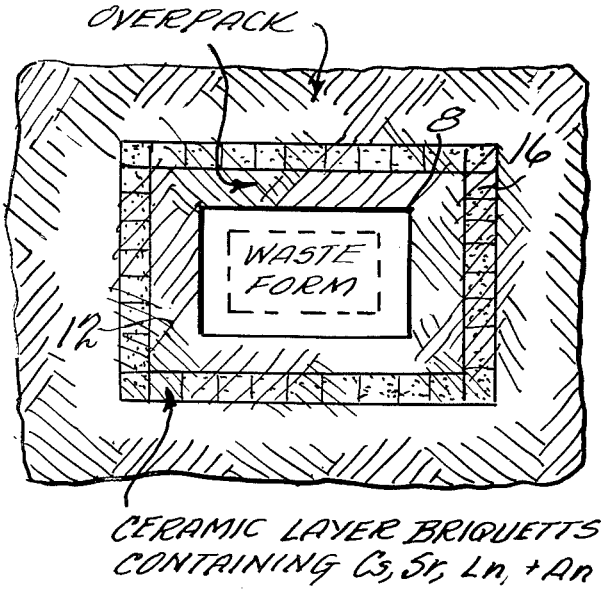
FIG. 5 is a schematic representation of one configuration of the new composition.

One of the configurations in which the new material will be used is shown in FIG. 5. Here the "ion-doped" layer is incorporated as a layer of briquettes 16.

Figure 6:
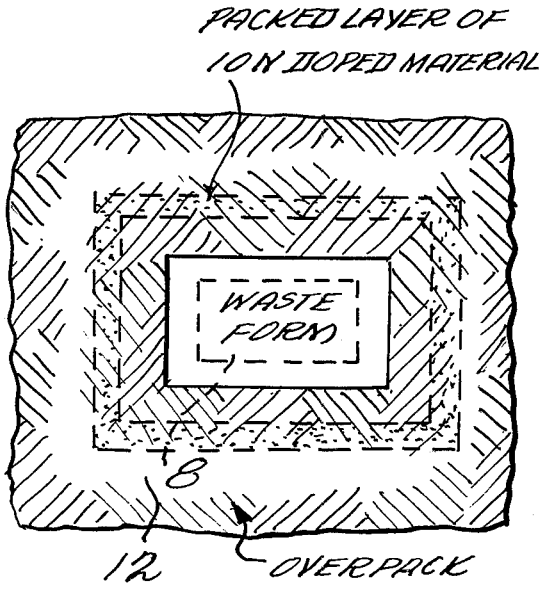
FIG. 6 is a schematic representation of an alternative configure of the new composition.

Another configuration is shown in FIG. 6 where the ion-doped material is simply tamped in sequence as the overpack material is put in place.

A third arrangement is simply to have the entire overpack layer contain some of the ion-doped material.

While the Cs, Sr, Ln, An, I, Mn and other ions can be introduced as virtually any salt, cost-effectiveness dictates that these be added as relatively insoluble materials, only slightly more soluble in the probable repository environment than the waste form itself. Since the waste forms are designed to be maximally insoluble, one can use relatively small amounts of quite insoluble phases. Thus, for Sr, its common ore celestite ($SrSO_4$) is adequate in some repository environments; however, in most, a ceramic material such as strontium feldspar ($SrAl_2Si_2O_8$) or its partial solid solutions with ordinary calcium feldspar of the general formula $Ca_{1-x}Sr_xAl_2Si_2O_8$ where x is a number less than 1 and greater than 0 will suffice. Similar series of solid solutions with the structural formula $Ca_{1-x}Sr_xSiO_3$—which can be made readily by reacting $CaCO_3$, $SrSO_4$, and sand, are also suitable.

For the introduction of Cs, various Cs-containing mineral phases (natural and synthetic) are available. Among them, natural and synthetic pollucite and $CsAlSi_5O_{12}$, partial solid solutions of the $(Ba_{1-x}Cs_{2x})$ variety in the celsian, magnetoplumbite, or hollandite structures. For the actinides, a mixture of various uranium and thorium minerals (such as uraninite, thorite, etc.) and rare-earth ores (such as bastnaesite), should be adequate. However, synthetic rare-earth silicates and aluminates made by reacting the "natural" mix of the larger rare-earth ions with silica or alumina, can be tailored to a solubility just slightly greater than the waste form.

In summary, there is placed a special layer of overpack or backfill material around a nuclear waste canister, the special layer comprising a natural mineral and/or a ceramic material or other source of the non-radioactive analogue of the radionuclide(s) of concern. Preferably, the composition of this overpack or backfill is completely and simply adjusted by selecting and combining appropriate mineral or ceramic phases which are only slightly more soluble than the waste form in repository fluids, e.g., water.

Pollucite, $CsAlSi_5O_{12}$, and the appropriate solid solution of Cs in magnetoplumbite, celsian, or hollandite, and virtually all relatively insoluble Cs compounds with $Al_2O_3$, $SiO_2$, $P_2O_5$, and $TiO_2$ in any combination are useful additives for this tailored overpack.

Celestite ($SrSO_4$), strontium feldspar, or any other strontium compounds with $Al_2O_3$, $SiO_2$, $P_2O_5$ singly or in any combination make excellent strontium overpack materials.

All the major natural ores of uranium and thorium can serve as sources of actinides in the overpack. In addition, the rare earth ores or oxides themselves, or the combinations of them with $Al_2O_3$, $SiO_2$ and/or $P_2O_5$ can provide lanthanide ions to mimic the actinides in the new tailored overpack and used in place of them.

The amounts of "ionically-charged" overpack that will be used around each canister is an engineering parameter readily and easily chosen by the systems designer, just as is the thickness of the canister and dilution of the waste form.

According to the invention, there is provided a process for constructing a "chemical container" or "reverse thermodymanic barrier" by surrounding a canister of nuclear waste placed in a repository with an appropriate (e.g., natural or synthetic) mineral overpack containing a substantial amount of Cs, Sr, An, and other fission product radionuclide ions.

This overpack may be emplaced in one of several ways:

(1) As a tamped-in mixture of clays, zeolites, etc., with the ion-dopant materials;

(2) As ceramic briquettes of the ion-dopant materials surrounding an inner layer of overpack and optionally more overpack outside the briquettes;

(3) In various concentrations dispersed throughout the overpack (or backfill) material.

Such a reverse thermodymanic chemical gradient of species such as Cs, Sr, An, I, Te, Mn (for Tc), or Ln (for An) achieved by placing between 0.1 and 100× (where × stands for times) the total contained amount of the ion contained in the waste form into appropriately insoluble overpack materials will provide a more cost-effective total waste package than engineering a more highly insoluble waste form.

The upper limit of 100× is not critical, and much higher amounts can be used in the overpack but are not normally justified economically. Criticality of the lower limit is that there be sufficient ions present in the overpack to insure a tendency of the ions of the elements involved to go into the waste form or other container. Thus, in a Batelle process using a glass matrix the release rate of the radioactive material is about $10^{-5}$ $gm/cm^2$ per day and the ion concentration in the overpack need only be sufficient to overcome this gradient and prevent waste from going through the canister. In other words, the concentration of ions in the overpack should be sufficient to exceed the leachability rate into the environment. Usually the concentration of ions in the overpack will exceed 1× the concentration of radionuclide ions in the waste.

The product can comprise, consist essentially of, or consist of the stated materials and the process comprise, consist essentially of, or consist of the recited steps with the stated materials.

I claim:

1. A nuclear waste package comprising any material containing a radionuclide and a surrounding overpack or backfill containing a non-radioactive compound of the element or analogue of the element of the radionuclide or a natural or synthetic mineral containing an actinide which provides a greater concentration of ions of the non-radioactive elements than are provided by the radionuclides.

2. A nuclear waste package according to claim 1 wherein the radionuclide comprises Cs, Sr, I, Tc, or actinide element and the overpack or backfill contains a non-radioactive element which is Cs, Sr, I, Mn, or lanthanide element.

3. A nuclear waste package according to claim 2 wherein the radionuclide comprises radioactive Cs and the non-radioactive element comprises Cs.

4. A nuclear waste package according to claim 2 wherein the radionuclide comprises radioactive Sr and the non-radioactive element comprises Sr.

5. A nuclear waste package according to claim 2 wherein the radionuclide comprises a radioactive actinide element and the non-radioactive element comprises a lanthanide element.

6. A nuclear waste package according to claim 1 wherein there is employed in the overpack or backfill a form of the non-radioactive element or actinide which is only slightly more soluble than the radioactive waste form of the element in the repository fluid.

7. A nuclear waste package according to claim 6 wherein the radionuclide comprises Cs, Sr, I, Tc, or actinide element and the overpack or backfill contains a non-radioactive element which is Cs, Sr, I, Mn, or lanthanide element.

8. A nuclear waste package according to claim 7 wherein the overpack or backfill material comprises a mineral or ceramic material containing said non-radioactive element or actinide in the form of a compound.

9. A nuclear waste package according to claim 8 wherein the radioactive element is Cs and the overpack or backfill contains the non-radioactive element in the form of a compound of Cs with at least one of $Al_2O_3$, $SiO_2$, $P_2O_5$, and $TiO_2$.

10. A nuclear waste package according to claim 8 wherein the radioactive element is Sr and the overpack or backfill contains the non-radioactive element in the form of a compound of Sr with at least one of $Al_2O_3$, $SiO_2$, and $P_2O_5$.

11. A nuclear waste package according to claim 8 wherein the radioactive element is an actinide with the overpack or backfill contains a non-radioactive element which is a lanthanide element in the form of a lanthanide oxide or compound of a lanthanide oxide with at least one of $Al_2O_3$, $SiO_2$, and $P_2O_5$.

12. A nuclear waste package according to claim 1 wherein the overpack or backfill is present as a tamped in mineral containing ion-dopant of the non-radioactive element.

13. A nuclear waste package according to claim 1 wherein the overpack or backfill is present as ceramic briquettes of containing ion-dopant of the non-radioactive element or actinide containing mineral surrounding an inner layer of overpack or backfill.

14. A nuclear waste package according to claim 13 containing additional overpack or backfill outside the briquettes.

15. A nuclear waste package according to claim 1 wherein the non-radioactive element or actinide containing mineral is present in various ion concentrations dispersed through the overpack or backfill.

16. A nuclear waste package according to claim 2 having a reverse thermodynamic chemical gradient of non-radioactive Cs, Sr, lanthanide, I, or Mn in an amount between 0.1 and 100× the total contained amount of the ion contained in the waste form in an insoluble overpack or backfill material.

17. A package according to claim 16 wherein the non-radioactive concentration is over 1×.

18. A process for constructing a reverse thermodynamic barrier comprising surrounding the nuclear waste form of claim 1 in a repository with a mineral overpack or backfill containing the non-radioactive element or actinide containing mineral in compound form.

19. A process according to claim 18 comprising tamping in a mixture of the mineral and an ion-dopant of the non-radioactive element or actinide mineral around the nuclear waste package.

20. A process according to claim 18 comprising surrounding a layer of overpack with ceramic briquettes ion-doped with a compound of the non-radioactive element.

21. A process according to claim 20 including the step of placing additional overpack or backfill around the briquettes.

22. A process according to claim 1 wherein the overpack or backfill contains 0.1 to 100× the total amount of ion contained in the radioactive waste form.

* * * * *